US008671485B2

(12) United States Patent
Smallman et al.

(10) Patent No.: US 8,671,485 B2
(45) Date of Patent: Mar. 18, 2014

(54) INFANT APPARATUS

(76) Inventors: Derek Smallman, Naples, FL (US); Susan Smallman, Naples, FL (US)

( * ) Notice: Subject to any disclaimer, the term of this patent is extended or adjusted under 35 U.S.C. 154(b) by 0 days.

(21) Appl. No.: 13/643,417

(22) PCT Filed: Jul. 12, 2011

(86) PCT No.: PCT/US2011/043631

§ 371 (c)(1),
(2), (4) Date: Oct. 25, 2012

(87) PCT Pub. No.: WO2013/009294

PCT Pub. Date: Jan. 17, 2013

(65) Prior Publication Data

US 2013/0174316 A1 Jul. 11, 2013

(51) Int. Cl.
*A47D 13/08* (2006.01)

(52) U.S. Cl.
USPC ..... 5/655; 5/417; 5/420; 5/691; 5/413 R; 5/413 AM; 5/494; 5/648

(58) Field of Classification Search
USPC ..... 5/417, 420, 691, 413 R, 413 AM, 655, 5/494, 648
See application file for complete search history.

(56) References Cited

U.S. PATENT DOCUMENTS

| | | | | |
|---|---|---|---|---|
| 2,751,268 | A * | 6/1956 | Creelman | 5/603 |
| 3,729,752 | A * | 5/1973 | Huggins | 5/93.1 |
| 5,046,204 | A * | 9/1991 | Mohler | 5/413 R |
| 5,058,226 | A * | 10/1991 | Crosby | 5/494 |
| 5,524,640 | A * | 6/1996 | Lisak et al. | 5/655 |
| 5,551,108 | A * | 9/1996 | Butler, III | 5/655 |
| 6,757,922 | B2 * | 7/2004 | Chancey | 5/482 |
| 6,817,048 | B1 | 11/2004 | LaRosa | |
| 7,716,764 | B2 * | 5/2010 | Joe et al. | 5/655 |
| 7,757,320 | B2 * | 7/2010 | Lord et al. | 5/655 |
| 8,074,312 | B2 * | 12/2011 | Tullous | 5/655 |
| 2005/0210583 | A1 | 9/2005 | Cook | |
| 2009/0007312 | A1 | 1/2009 | Greer | |
| 2009/0188046 | A1 | 7/2009 | Robles et al. | |
| 2009/0229056 | A1 * | 9/2009 | Edinger | 5/648 |
| 2011/0225738 | A1 * | 9/2011 | Vensel | 5/655 |
| 2012/0102645 | A1 * | 5/2012 | Schneider | 5/494 |

* cited by examiner

*Primary Examiner* — William Kelleher
(74) *Attorney, Agent, or Firm* — Shannon V. McCue; Hahn Loeser & Parks LLP

(57) ABSTRACT

An infant apparatus includes a top panel and a bottom panel having securing means that form an aperture between the top panel and the bottom panel. A longitudinally extending wall connects the top panel and the bottom panel forming at least a first leg holding section and a second leg holding section. The bottom panel further includes a sleeping surface securing means.

20 Claims, 6 Drawing Sheets

INFANT APPARATUS

TECHNICAL FIELD

The invention described herein relates to sleep apparatuses and, more particularly, to a sleep apparatus that secures an infant/child onto a surface.

DISCUSSION OF ART

Infant comfort and safety while sleeping is an ongoing issue for parents and caregivers. Most infants frequently change position while napping or sleeping. For example, when a parent or caregiver places an infant on his or her back on the sleeping surface in a crib or bed, the infant may roll onto his or her sides, front, and back many times during a period of sleep. Sudden Infant Death Syndrome (SIDS) or the sudden, unexplained death of an infant, has been a concern for parents and caregivers for many decades. Although the causes of SIDS are not fully known or understood, keeping an infant on his or her back is thought to decrease an infant's risk of SIDS.

Accordingly, a need exists for an infant apparatus that will help an infant stay on his or her back while sleeping.

BRIEF DESCRIPTION

In accordance with the present invention, there is provided an infant apparatus comprising a longitudinally extending top panel and a longitudinally extending bottom panel. The longitudinally extending top panel includes a first longitudinal end, a second longitudinal end, and a first fastening means on at least two top panel perimeter locations. The longitudinally extending bottom panel includes a first longitudinal end, a second longitudinal end, a second fastening means on at least two bottom panel perimeter locations, and a sleeping surface securing means. Further, the second fastening means and the first fastening means are securedly engagable and the bottom panel longitudinally extends past the second longitudinal end of the top panel to form a lateral aperture between the top panel and the bottom panel. The infant apparatus further includes a longitudinal extending wall that securedly connects the longitudinally extending top panel and the longitudinally extending bottom panel and the longitudinally extending top panel, the longitudinally extending bottom panel, and the longitudinally extending wall form at least a first leg holding section and a second leg holding section.

Also within the scope of the invention is an infant bag comprising a longitudinally extending top panel having a first fastening means on a top panel, a first longitudinal end, and a second longitudinal end and a longitudinally extending bottom panel having a second fastening means on a bottom panel. The second fastening means and the first fastening means are securedly engagable to form a lateral aperture between the top panel and the bottom panel. The infant bag further includes a longitudinal extending wall that securedly connects the longitudinally extending top panel and the longitudinally extending bottom panel between a first end and a second end, wherein the first end is adjacent to the first longitudinal end of the longitudinally extending top panel and the second end is between the first longitudinal end and the second longitudinal end of the longitudinally extending top panel. Further, the longitudinally extending top panel, the longitudinally extending bottom panel, and the longitudinally extending wall form at least a first leg holding section and a second leg holding section and the longitudinally extending bottom panel further includes a sleeping surface securing means.

Also within the scope of the invention is a method for securing an infant. The method includes providing a longitudinally extending top panel and a longitudinally extending bottom panel that longitudinally extends beyond the top panel and connecting the longitudinally extending top panel and the longitudinally extending bottom panel to a sleeping surface. The method includes providing a longitudinal extending wall securedly connecting the longitudinally extending top panel and the longitudinally extending bottom panel between a first end and a second end forming a first leg holding section and a second leg holding section. Further, the method includes securedly connecting the longitudinally extending top panel and the longitudinally extending bottom panel with securing means to prevent the front side of an infant from being adjacent to the longitudinally extending bottom panel.

These and other objects of this invention will be evident when viewed in light of the drawings, detailed description and appended claims.

BRIEF DESCRIPTION OF THE DRAWINGS

Reference is made to the accompanying drawings in which particular embodiments of the invention are illustrated as described in more detail in the description below, in which.

DETAILED DESCRIPTION

Figure 1:
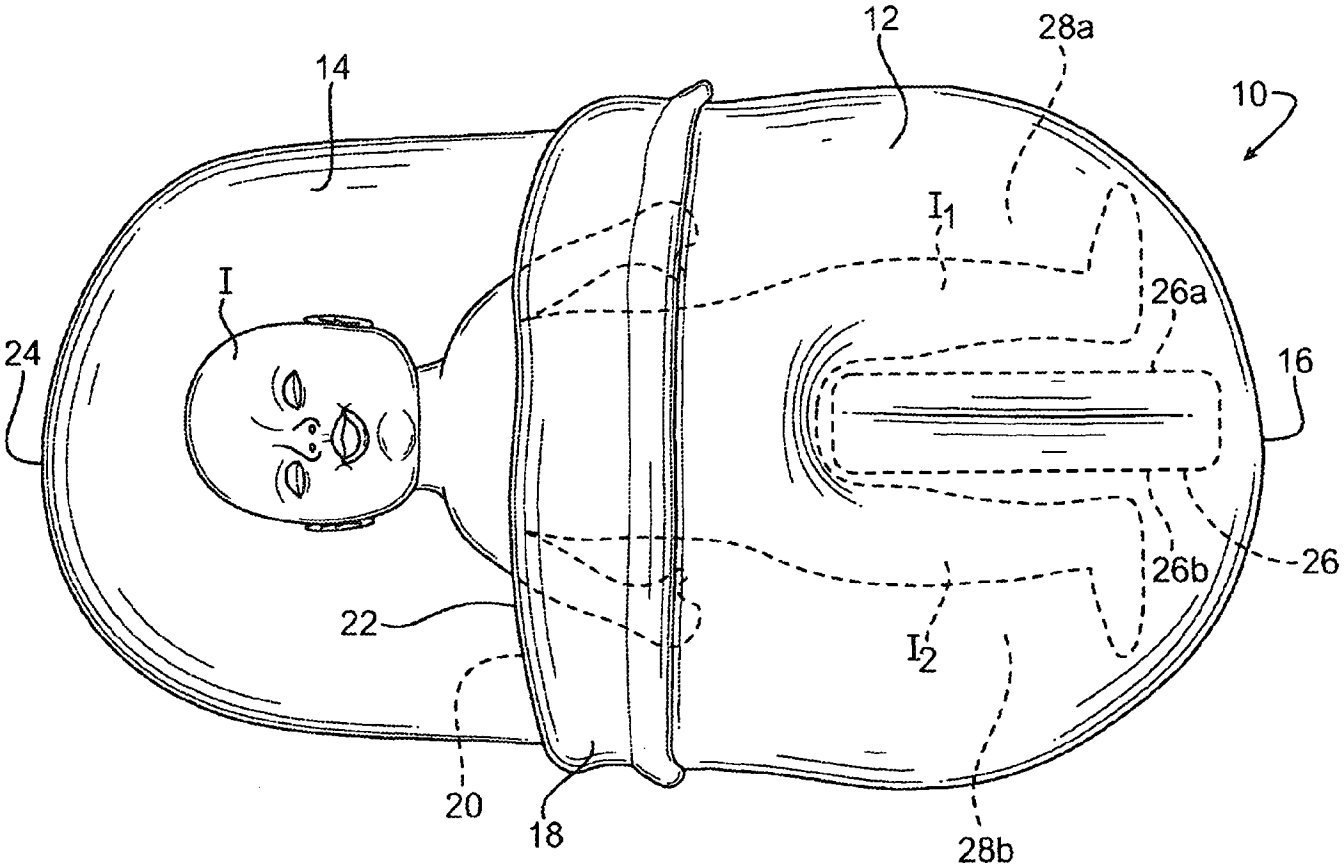
FIG. 1 is a top view of an infant apparatus having an infant disposed therein where the infant is partially illustrated in hidden lines.

The invention includes embodiments that relate to sleep apparatuses and, more particularly, to a sleep apparatus that secures an infant/child onto a surface. With reference to the drawings, wherein like reference numerals designate identical or corresponding parts throughout the several views, several embodiments of the disclosed sleep apparatus will be described. The embodiments are related to restricting movement of an infant/child, including newborn infants, after placement within the sleep apparatus and user modification of the sleep apparatus to accommodate various infant/child sizes. Other problems, including rolling or hitting parts of a crib or bed and pulling covers or blankets off or over an infant's head may also be obviated by using the disclosed embodiments. The embodiments may allow an infant to stay warm without using additional blankets, covers, or the like.

Referring now to the drawings wherein the showings are for purposes of illustrating an embodiment of the invention only and not for purposes of limiting the same, FIG. 1 discloses an infant/child apparatus 10 or infant bag having an infant I disposed between top panel 12 and bottom panel 14 where the infant is partially illustrated in dashed/hidden lines. Top panel 12 longitudinally extends between first longitudinal end 16 and adjustable folded portion 18. Folded portion 18 adjustably folds longitudinally towards first longitudinal end 16 to expose opening or aperture 20 formed between top panel 12 and bottom panel 14. Bottom panel 14 longitudinally extends below top panel 12 and is longitudinally exposed from lateral edge 22 of adjustable folded portion 18 to second longitudinal end 24 of infant apparatus 10. In the illustrated embodiment, infant I has opposing legs $I_1$ and $I_2$ adjacent opposing longitudinally extending sides 26*a* and 26*b*, respectively, of upward extending wall 26 (further discussed below). Further, folded portion 18 laterally extends across the chest of infant I.

In the illustrated embodiment, top panel 12 and bottom panel 14 have semi-circular ends, including first longitudinal end 16 and second longitudinal end 24. First longitudinal end 16 is adjacent to the infant's feet. The panels 12 and 14 generally take the shape of an elliptically-shaped sleeping surface. Infant apparatus 10 is securedly attached to and at least partially covers a crib, mattress, or the like. Infant apparatus 10 can be securedly attached to such using a sleeping surface securing means. A sleeping surface securing means can be one or more securing means disclosed herein, including buttons and loops, stitching, snaps, hook and loop, zippers, eyelets, adhesives, and others. Such securing means can be attached to the longitudinally extending bottom panel and sleeping surface, respectively, at any appropriate position on each. The sleeping surface and/or mattress may optionally be supported by a crib, bed, or other structure. In another embodiment, the top panel and the bottom panel have a partial square or a partial rectangular first longitudinal end and/or second longitudinal end or another shape. In yet another embodiment, the sleeping surface, mattress, or the like is configured as an additional part of the infant apparatus. In another embodiment, the top panel and the bottom panel are non-planar and take the shape of a sleeping surface that is non-planar, e.g., a car seat, stroller, or the like.

Top panel 12 and bottom panel 14 are each made from at least one layer of a natural or a synthetic textile, fabric, or cloth material that are each configured or fashioned to have the shape of infant apparatus 10. A non-limiting list of example materials includes cotton, wool, silk, nylon, polyester, acrylic, and fire retardant versions of the same. In an embodiment, the top panel and/or the bottom panel are made from at least two layers of natural or synthetic textile, fabric, or cloth material and include batting or insulation material positioned between the at least two layers. In an embodiment, the top panel and/or the bottom panel are securedly connected to child-safe toys and the like that an infant can play with before and/or after sleeping.

Figure 2:
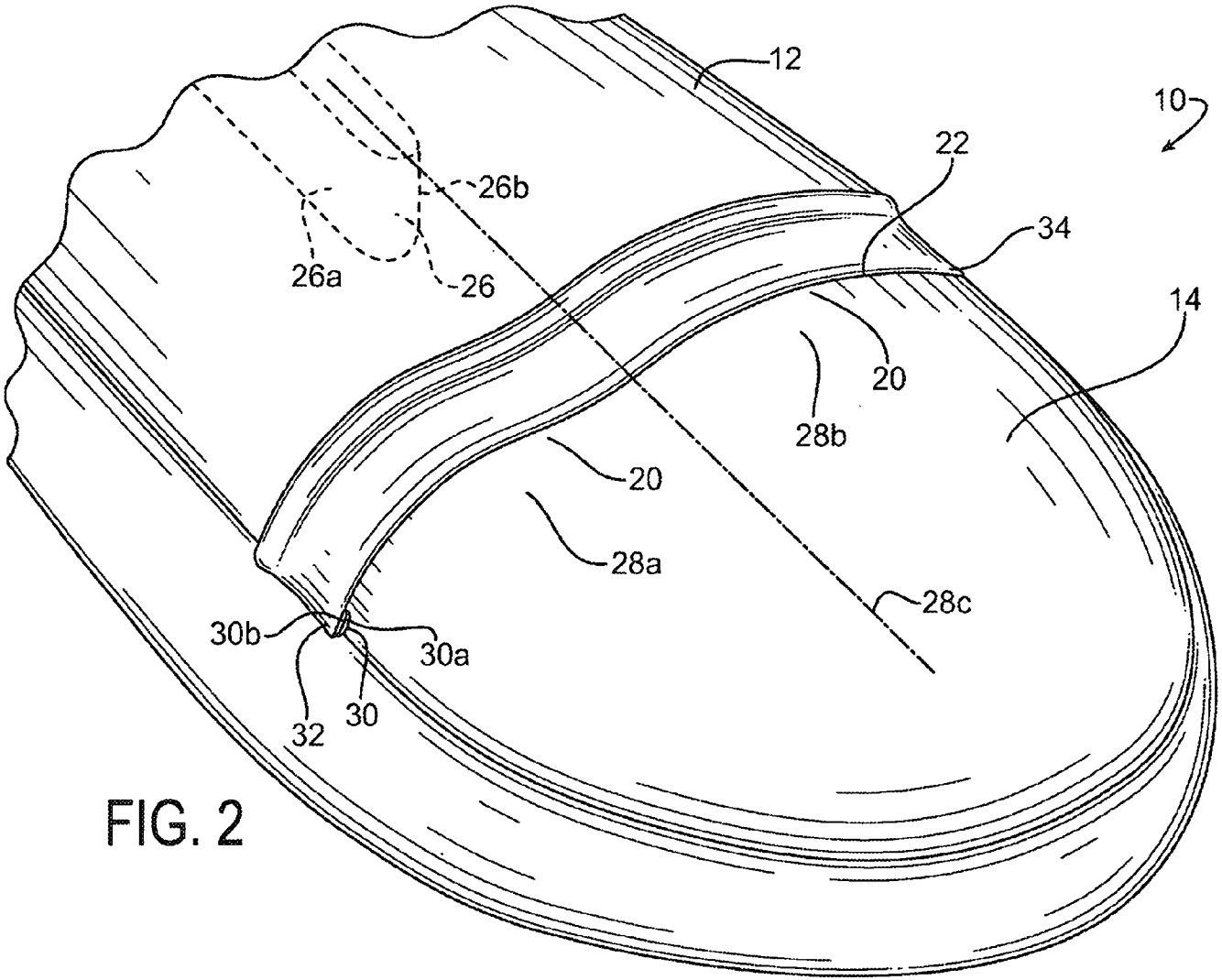
FIG. 2 is a top end perspective view of the infant apparatus showing an inner portion having a longitudinal wall spanning between top and bottom panels of the infant apparatus.

FIG. 2 illustrates a top end perspective view of infant apparatus 10 showing opening or aperture 20 formed between top panel 12 and bottom panel 14 when top panel 12 is longitudinally drawn towards first longitudinal end 16 and/or drawn upward relative to bottom panel 14. In the illustrated embodiment, upward extending wall 26 having opposing sides 26*a* and 26*b* extends from at least a portion of bottom panel 14 and longitudinally extends along about a lateral center 28*c* (shown partially in dashed lines) of bottom panel 14. In another aspect, upward extending wall 26 includes a telescoping member so wall 26 is longitudinally adjustable to accommodate infants of different heights or so the wall is adjustable as an infant grows in height. In an embodiment, the upward extending wall has more than one longitudinal piece that can be fashioned to make the upward extending wall longitudinally adjustable.

In the illustrated embodiment, the lateral position of upward extending wall 26 configured with top-panel 12 and bottom panel 14 forms first leg area 28*a* and second leg area 28*b* (also illustrated in FIG. 1). First leg area 28*a* and second leg area 28*b* provide space for first and second legs $I_1$ and $I_2$, respectively, of an infant (as shown in FIG. 1), preventing first leg $I_1$ from moving into second leg area 28*b* and preventing second leg $I_2$ from moving into first leg area 28*a*. Further, upward extending wall 26 is permanently attached to at least one portion of top panel 12, preventing the first leg or second leg from extending over or below upward extending wall 26. For example, upward extending wall 26 is permanently attached to longitudinal adjacent portions of top panel 12 and bottom panel 14. Upward extending wall 26 maintains first leg $I_1$ in first leg area 28*a* and maintains second leg $I_2$ in second leg area 28*b*. Therefore, an infant is prevented from longitudinally rotating and cannot roll onto its front side when initially positioned on its back side within infant apparatus 10 and secured therein. In an embodiment, the upward extending wall is adjustably attached to at least one portion of the top panel and the bottom panel, e.g., attached with a Velcro-like fastener having hooks and loops, snaps, or the like.

In an example, upward extending wall 26 is contiguously formed with and extends from bottom panel 14. In another embodiment, upward extending wall 26 is securedly affixed to bottom panel 14 and is securedly affixed to at least one portion of top panel 12. For example, upward extending wall 26 may be securedly affixed to at least a portion of bottom panel 14 and/or at least a portion of top panel 12 by at least one of the following securing means, including but not limited to: stitching, Velcro, zippers, buttons and loops, buttons and eyelets, ball and socket snaps, adhesives, and the like. In the illustrated embodiment, upward extending wall 26 is made from natural or synthetic textile, fabric, or cloth material, similar to the top and bottom panel materials discussed above.

Fastening means 30 securedly attaches upper portion of top panel 12 to bottom panel 14 in at least two locations, for example, a first lateral edge 32 and second lateral edge 34, i.e., in a number of locations along a top panel perimeter and corresponding bottom panel perimeter locations. Alternatively or in addition, fastening means are longitudinally disposed to allow the top panel to be adjusted to accommodate any number of infant sizes. Fastening means can be located on the outer and/or inner wall of the top panel for such purpose. For example, by folding down, the top panel can be shortened to accommodate infants of relatively smaller size. The top panel can also be subsequently adjusted via the fastening means to accommodate infants as they grow in size.

In one example, the size of the infant apparatus can be modified by use of removably secure fastening means. For instance, fastening means 30 can include a socket 30*a* securedly connected to bottom panel 14 and a ball fastener 30*b* securedly connected to top panel 12 to modify the length of the top panel relative to the bottom panel 14. In this example, socket 30*a* and ball fastener 30*b* are each longitudinally and laterally aligned to facilitate snapping ball fastener 30*b* into socket 30*a*. In another embodiment, the fastening means includes at least one of the following: Velcro-like fastener, zippers, buttons and loops, buttons and eyelets, adhesives, and other permanent or temporary securement devices.

In another example, the location of the fastening means are disposed to allow modification of the shape of the top and/or bottom panels. For instance, the shape of the top panel can be changed, wherein lateral edges 32, 34 are coupled to the bottom panel to change from relatively linear or straight edge to another profile. In one embodiment, the lateral edges include a first fastening means component wherein the counterpart second fastening means component is disposed toward the centerline of the sleep apparatus 10. In this manner, the edges of the top panel can be "drawn in" to provide further securement of an infant within the sleep apparatus. Other profiles including saw-toothed, rounded, chamfered, scrolled, and the like are also contemplated within the scope of this invention. For this purpose, material used to fabricate the top panel can also be altered to include one or more notches, slots, punchouts, or other alteration to allow placement of an edge without bunching material otherwise located within the top panel 21. Thus, one or more fastening devices can be employed to allow trouble-free user modification of the size and/or shape of the infant apparatus 10.

Figure 3:
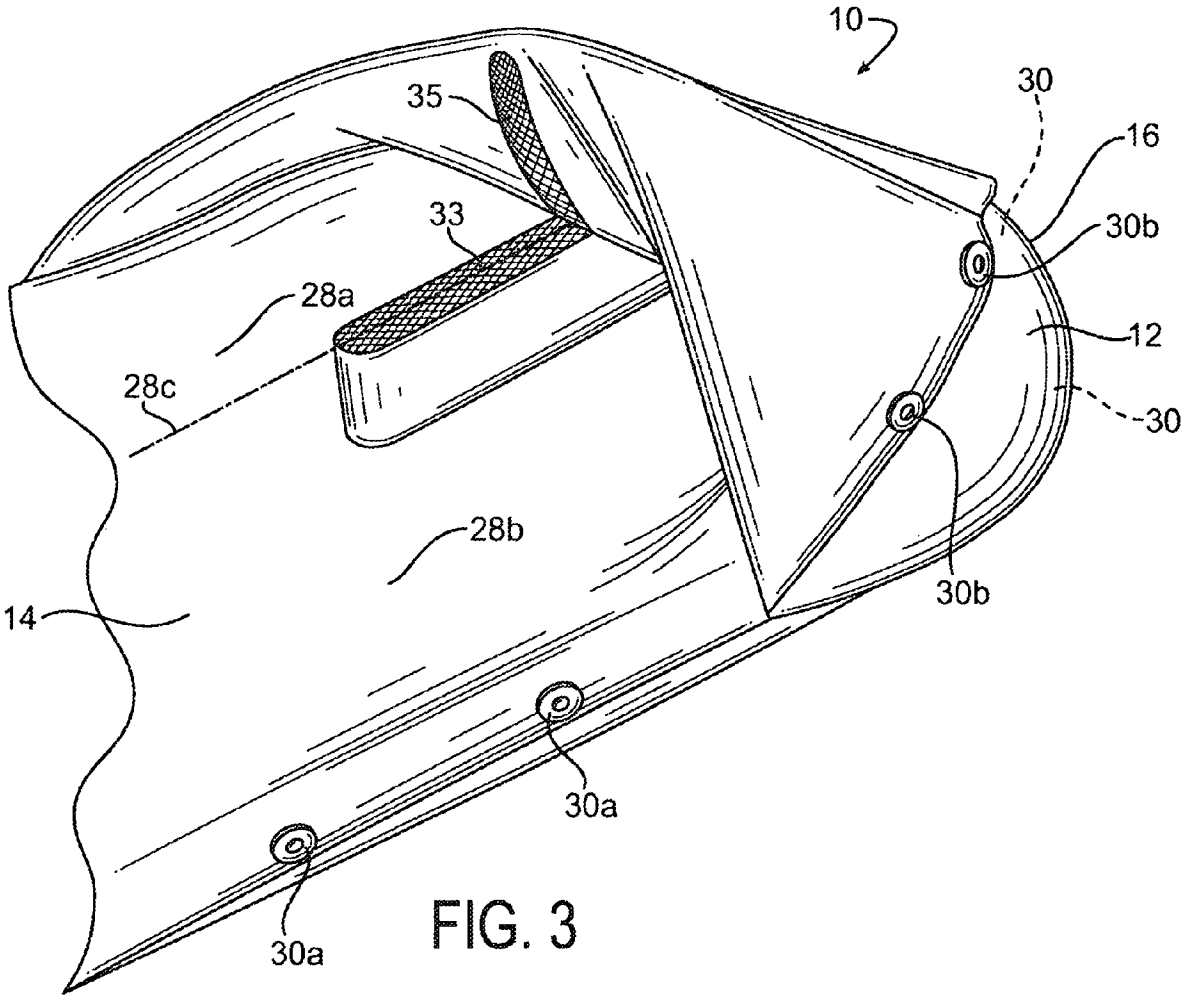
FIG. 3 is a top side perspective view of the infant apparatus showing the top panel folded back and the fastening means for the top and bottom panels, further illustrating the inner portion of the infant apparatus.

FIG. 3 is a top side perspective view of infant apparatus 10 showing a portion of top panel 12 longitudinally folded toward the first longitudinal end 16, exposing another portion of bottom panel 14. A fastening means including hooks 33 on upward extending wall 26 and loops 35 on an inner portion of top panel 12 intermesh to form a removably attached fastening means between the upward extending wall 26 and top panel 12. In an embodiment, fastening means on the upward extending wall and the top panel and/or bottom panel may include Velcro-like fasteners, zippers, buttons and loops, buttons and eyelets, adhesives, and other temporary securing devices. In the illustrated embodiment, fastening means 30 securedly affixes top panel 12 to bottom panel 14 in a plurality of spaced locations along the perimeter of infant apparatus 10 forming a curvilinear perimeter. For example, fastening means 30 includes socket 30*a* securedly connected to bottom panel 14 (shown in two locations) and ball fastener 30*b* is securedly connected to top panel 12 (shown in two locations). As discussed above, sockets 30*a* and ball fasteners 30*b* are each aligned to facilitate snapping ball fastener 30*b* into socket 30*a*, wherein socket 30*a* has an aperture or opening that receivably engages ball fastener 30*b*. In another embodiment, the fastening means includes at least one of the following: Velcro, zippers, buttons and loops, buttons and eyelets, adhesives, fabric knots, and the like.

Figure 4:
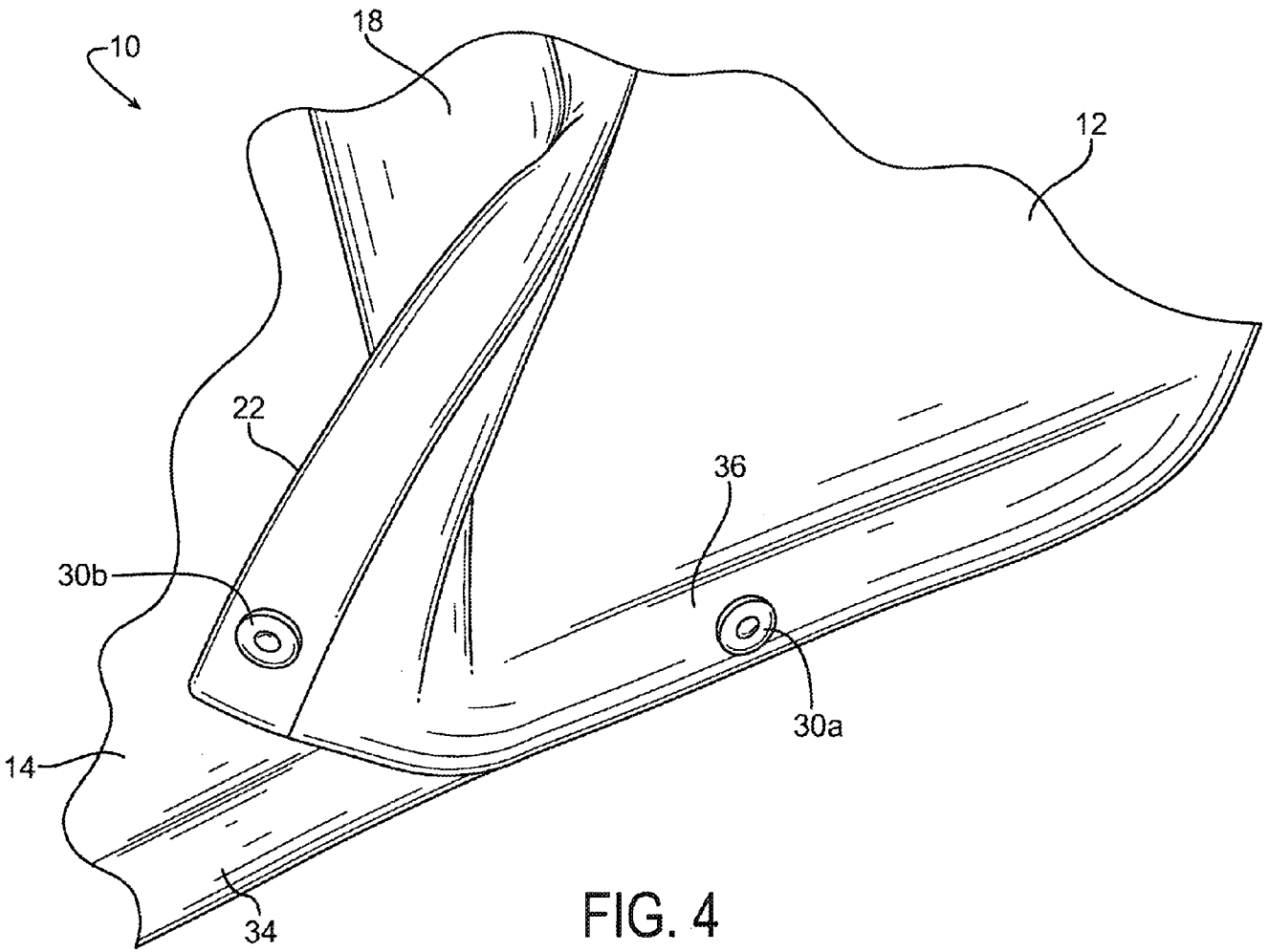
FIG. 4 is a side perspective view of a portion of the infant apparatus illustrating the fastening means that secures the folded portion to an edge of the top panel.

FIG. 4 is a side perspective view of a portion of infant apparatus 10 illustrating fastening means that securedly attach folded portion 18 to a longitudinal edge of top panel 12. In the illustrated embodiment, fastening means securedly affixes folded portion 18 to longitudinal edge 36 of top panel 12 in at least one location. In the illustrated embodiment, for example, fastening means includes a socket 30*a* and a ball fastener 30*b* that securedly connect, wherein socket 30*a* is securedly connected to longitudinal edge 36 of top panel 12 and ball fastener 30*b* is securedly connected to folded portion 18. Folded portion 18 and fastening means 30 facilitate changing the longitudinal length of top panel 12 to accommodate the longitudinal length or height of an infant (not shown). Lateral edge 22 of top panel 12 is longitudinally adjustable to be offset from the chin or chest of the infant (as illustrated in FIG. 1).

As discussed above, sockets 30*a* and ball fasteners 30*b* are each aligned, e.g., longitudinally and laterally, to facilitate snapping ball fastener 30*b* into socket 30*a*. In an embodiment, the fastening means includes at least one of the following: Velcro, zippers, buttons and loops, buttons and eyelets, adhesives, fabric knots, and the like. In an embodiment, additional fastening means are located laterally across infant apparatus 10 between folded portion 18 and top panel 12 to insure an infant cannot pull folded portion 18 longitudinally towards the second longitudinal end, e.g., over the infants head. In yet another embodiment, the top panel does not include a folded portion.

Figure 5:
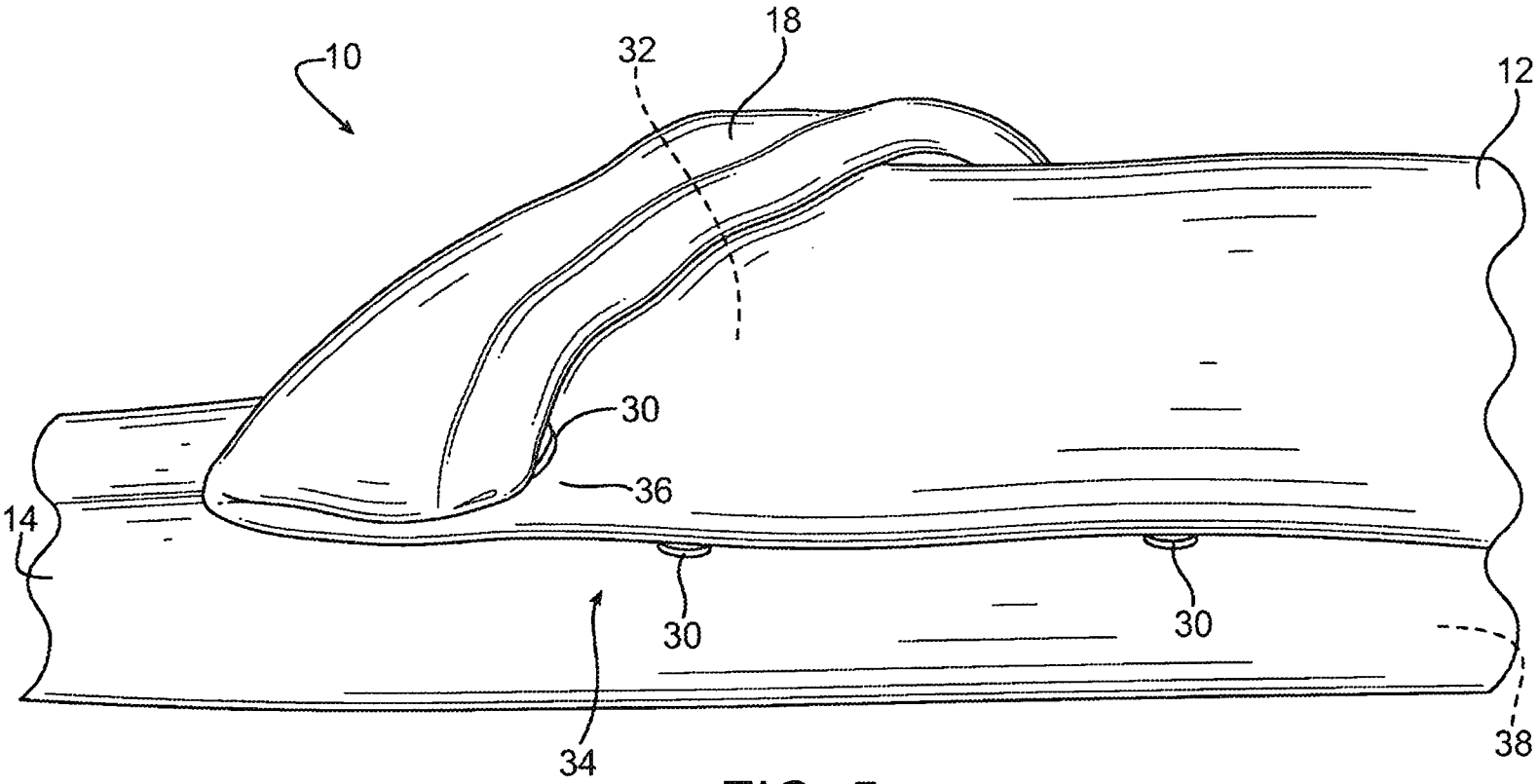
FIG. 5 is a side view of the infant apparatus illustrating the top and bottom panels.
Figure 6:
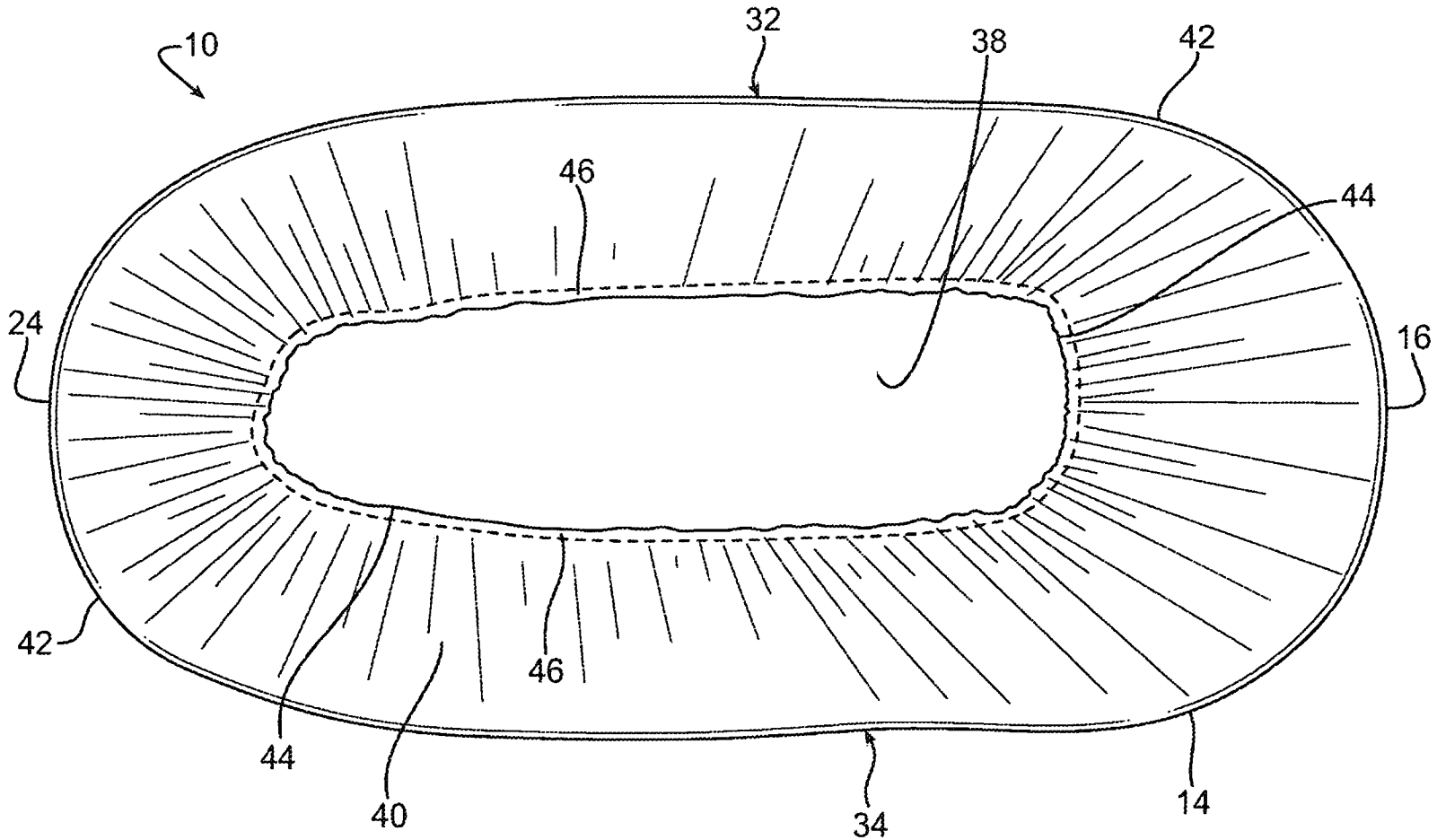
FIG. 6 is a bottom view of the infant apparatus securedly fashioned to a sleeping surface.

FIG. 5 is a side view and FIG. 6 is a bottom view of infant apparatus 10 securedly affixed to a sleeping surface 38. In an embodiment, the infant apparatus is securedly affixed to a crib mattress, bed mattress, car seat, stroller seat, or the like. In the illustrated embodiments, top panel 12 securedly connects to bottom panel 14 in a plurality of locations along an outer perimeter of infant apparatus 10. For example, top panel 12 securedly connects to bottom panel 14 along first lateral edge 32, second lateral edge 34, and along first longitudinal end (not shown) forming a curvilinear closure perimeter. In another embodiment, the top panel securedly connects to the bottom panel along at least the first lateral edge and the second lateral edge, but may not securedly connect along the first longitudinal end to allow air circulation to more freely move through the first end. In another example, the top panel may be partially permanently secured (e.g., sewn, glued, etc.) to the bottom panel, such as a bottom curvilinear portion, wherein the upper portion is removably secured to the bottom panel.

FIG. 6 further illustrates bottom panel 14 elastically connected to sleeping surface 38 or crib mattress, bed mattress, and the like. In this embodiment, the sleep surface is shown as generally elliptical in shape, but a geometric shape suitable for such purpose is also contemplated, including a square, a rectangle, an oval, a circle, and variations thereof. Bottom panel 14 includes a formable panel 40 that stretches past the outer perimeter 42 of sleeping surface 38 and extends radially inward to edge 44. For example, formable panel 40 may be fashioned from fabric or cloth and includes an elastic fabric ring 46 adjacent to inward edge 44.

The elastic fabric ring 46 is configured to stretch around the outer perimeter of the sleeping surface and then inwardly contracts to a smaller size to form inward edge 44. Therefore, infant movements will not cause infant apparatus 10 to disengage from the sleeping surface or crib mattress because the elastic fabric ring 46 securedly holds infant apparatus 10 in place. In another embodiment, the formable panel may include snap and lock fasteners, Velcro or Velcro-like fasteners, cloth ties, and the like to securedly connect opposing sides of formable panel to insure the formable panel remains secured beneath the sleeping surface. In yet another embodiment, the infant apparatus is permanently coupled to the sleeping surface.

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

What is claimed is:

1. An infant apparatus comprising:

a flexible longitudinally extending top panel configured to secure an infant on its back having a first longitudinal end, a second longitudinal end, and a first fastening means on at least two top panel perimeter locations;

an adjustable folded portion of the second longitudinal end of the longitudinally extending top panel configured to fold at one or more lengths corresponding to a size of the infant;

a substantially flat flexible longitudinally extending bottom panel having a first longitudinal end, a second longitudinal end, a second fastening means on at least two bottom panel perimeter locations, and a sleeping surface securing means, wherein the second fastening means and the first fastening means are securedly engagable, and wherein the bottom panel longitudinally extends past the second longitudinal end of the top panel forming a lateral aperture between the top panel and the bottom panel; and a longitudinal extending wall having a substantially rectangular section that securedly connects the longitudinally extending top panel and the longitudinally extending bottom panel, wherein the longitudinal extending wall extends above a highest portion of the longitudinally extending bottom panel, and wherein the longitudinally extending top panel, the longitudinally extending bottom panel, and the longitudinally extending wall form at least a first leg holding section and a second leg holding section.

2. The infant apparatus of claim 1, wherein the adjustable folded portion securedly attaches to at least a first lateral edge of the longitudinally extending top panel.

3. The infant apparatus of claim 1, wherein the first fastening means and the second fastening means includes one or more of ball-and-socket fasteners, hook and loop fasteners, button and loop fasteners, button and eyelet fasteners, one or more zippers, and an adhesive.

4. The infant apparatus of claim 1, wherein the second fastening means and the first fastening means are securedly engagable along at least a first lateral edge, a second lateral edge, and a first longitudinal end.

5. The infant apparatus of claim 1, wherein the sleeping surface securing means includes at least one of a formable panel and an elastic ring.

6. The infant apparatus of claim 5, wherein the sleeping surface securing means is a formable panel and the formable panel further includes at least one of the following: a snap and lock fastener, a Velcro like fastener, and a cloth tie.

7. The infant apparatus of claim 1, wherein the longitudinal extending wall longitudinally extends from a first end to a second end, wherein the first end is adjacent to the first longitudinal end of the longitudinally extending top panel and the second end is between the first longitudinal end and the second longitudinal end of the longitudinally extending top panel.

8. An infant bag, comprising:

a longitudinally extending top panel having a plurality of first fastening means on a top panel, a first longitudinal end, and a second longitudinal end constructed of one or more top panel materials;

a substantially flat longitudinally extending bottom panel having a plurality of second fastening means, wherein the plurality of second fastening means and the plurality of first fastening means are securedly engagable to form a lateral aperture at an aperture location between the top panel and the bottom panel constructed of one or more bottom panel materials; and a longitudinal extending wall having a substantially rectangular cross-section that securedly connects the longitudinally extending top panel and the longitudinally extending bottom panel between a first end and a second end, wherein the first end is adjacent to the first longitudinal end of the longitudinally extending top panel and the second end is between the first longitudinal end and the second longitudinal end of the longitudinally extending top panel, wherein the longitudinal extending wall projects above a highest portion of the longitudinally extending bottom panel, wherein the longitudinally extending top panel, the longitudinally extending bottom panel, and the longitudinally extending wall form at least a first leg holding section and a second leg holding section, wherein the longitudinally extending bottom panel further includes a sleeping surface securing means, wherein the one or more top panel materials and the one or more bottom panel materials are foldable woven materials, and wherein the aperture location corresponds to a size of an infant.

9. The infant bag of claim 8, wherein the second fastening means and the first fastening means are securedly engagable along at least a first lateral edge, a second lateral edge, and a first longitudinal end.

10. The infant bag of claim 8, wherein the sleeping surface securing means includes at least a formable panel configured to securedly affix to a sleeping surface.

11. The infant bag of claim 8, wherein the first fastening means on the top panel is adjustably disposed on a perimeter of the top panel or adjustably disposed on another portion of the top panel towards a center line of the infant bag, and wherein the second fastening means on the bottom panel is adjustably disposed on a perimeter of the bottom panel or adjustably disposed on another portion of the bottom panel towards the center line of the infant bag.

12. A method for securing an infant comprising:

providing a flexible and substantially flat longitudinally extending top panel and a flexible and substantially flat longitudinally extending bottom panel that longitudinally extends beyond the top panel;

folding the longitudinally extending top panel to a location related to a size of an infant;

connecting the longitudinally extending top panel and the longitudinally extending bottom panel to a sleeping surface;

providing a longitudinal extending wall having a substantially rectangular section securedly connecting the longitudinally extending top panel and the longitudinally extending bottom panel between a first end and a second end forming a first leg holding section and a second leg holding section, wherein the longitudinal extending wall projects above a highest portion of the longitudinally extending bottom panel; and securedly connecting the longitudinally extending top panel and the longitudinally extending bottom panel with securing means to prevent the front side of the front side of the infant from being adjacent to the longitudinally extending bottom panel.

13. The method of claim 12 further comprising securing an adjustable folded portion of the top panel to at least one lateral edge of the longitudinally extending top panel.

14. The method of claim 12 further comprising preventing a first infant leg from moving into the second leg holding section and preventing a second infant leg from moving into the first leg holding section.

15. The method of claim 12 further comprising placing the sleeping surface onto a crib, bed, stroller, or car seat.

16. The infant apparatus of claim 1, wherein the longitudinal extending wall is configured to extend and retract in a longitudinal direction based at least in part on the size of the infant.

17. The infant apparatus of claim 1, wherein the longitudinally extending top panel includes one or more slots to facilitate resizing of the infant apparatus.

18. The infant bag of claim 8, wherein the plurality of first fastening means and plurality of second fastening means are disposed toward a center line of the infant bag, and the plurality of first fastening means and plurality of second fastening means are configured to draw in at least the longitudinally extending top panel toward a center line of the infant bag.

19. The method of claim 12, further comprising opening a circulation portion between the longitudinally extending top panel and the longitudinally extending bottom panel, the circulating portion configured to permit air circulation between the longitudinally extending top panel and the longitudinally extending bottom panel.

20. The infant apparatus of claim 1, wherein a top portion of the longitudinal extending wall is sloped downward in the direction of the first longitudinal end.

* * * * *